US005089157A

United States Patent [19]

Trivett

[11] Patent Number: 5,089,157

[45] Date of Patent: Feb. 18, 1992

[54] HOT MELT LUBRICANT HAVING GOOD WASHABILITY

[75] Inventor: Robert L. Trivett, Aurora, Ill.

[73] Assignee: Nalco Chemical Company, Naperville, Ill.

[21] Appl. No.: 670,660

[22] Filed: Mar. 18, 1991

[51] Int. Cl.[5] ..... C10M 173/02

[52] U.S. Cl. ..... 252/51.5 R; 252/51.5 A; 252/52 R; 252/56 S; 252/56 R

[58] Field of Search ..... 252/51.5 A, 51.5 R, 252/52 R, 56 S, 56 R

[56] References Cited

U.S. PATENT DOCUMENTS 4,846,986 7/1989 Trivett ..... 252/49.5

*Primary Examiner*—Brian E. Hearn
*Assistant Examiner*—M. Nuzzolillo
*Attorney, Agent, or Firm*—John G. Premo; Robert A. Miller

[57] ABSTRACT

A hot melt prelubricant especially adapted for lubricating and protecting sheet metal used in the manufacture of automobiles and appliances and having the property of being easily removed by alkaline cleaners used in such industries which has the formula listed below:

| | Ingredients | % by weight |
|---|---|---|
| A. | $C_{14}$–$C_{22}$ saturated fatty acid ester of a polyhydric alcohol lubricant | 60.0–65.0 |
| B. | Aspartic acid diester of a 1-(2-hydroxy ethyl)2-$C_{11}$–$C_{21}$ imidazoline lubricant | 8.0–15.0 |
| C. | Ethylene copolymer | 0.5–2.0 |
| D. | Amide formed from 2 moles of stearic acid with 1 mole of diethanol amine | 20.0–25.0 |
| E. | Antioxidant | 0.5–2.0 |

2 Claims, No Drawings

HOT MELT LUBRICANT HAVING GOOD WASHABILITY

TECHNICAL FIELD OF THE INVENTION

The present invention is in the technical field of metalworking lubricants, particularly solid film prelubes for steel in automotive and appliance applications.

BACKGROUND OF THE INVENTION

Lubricants are generally employed in metalworking operations. Such operations include rolling, forging, blanking, bending, stamping, drawing, cutting, punching, spinning, extruding, coining, hobbing, swaging and the like. The present invention concerns lubricants for such type of metalworking operations, and in particular such operations as employed in the automotive and appliance applications. In the automotive and appliance fields, the term "forming" is used as a broad term to cover all pressworking operations on sheet metal, which operations may be further categorized as all mechanical processes where sheet metal is formed into specific shapes by the use of mechanical presses. Automotive and appliance formed parts may be produced by one or a combination of three fundamental operations, defined as stamping, shallow drawing and deep drawing. Stamping is further defined as all forming operations where parts are formed from sheet metal where there is no change in the thickness of the sheet metal. Drawing defines all forming operations where there is a change or reduction in thickness of the sheet metal. Shallow drawing forms a shape no deeper than one half its diameter with only small reductions in metal thickness. Deep drawing forms shapes deeper than half its diameter with substantial reductions in metal thickness.

Metalworking lubricants facilitate these operations by reducing friction between the metal being worked and the tooling employed for that process. This reduces the power required for a given operation, the wear of the surfaces of the tooling, and prevents adhesion between the metal being worked and the tooling operating thereon. Lubricants also prevent adhesion between metal pieces during storage, handling or operations. Also, they often provide corrosion protection to the metal being processed. In automotive and appliance applications prevention of adhesion between metal pieces and between such pieces and the work elements is of extreme importance.

In some metalworking processes, including automotive and appliance applications, coils or rolls of steel, in particular cold rolled or galvanized steel sheets, are cut into pieces, called blanks, which are stamped or drawn to produce the desired parts. Such automotive parts formed by stamping or drawing, as these terms are generally used, include fenders, hoods, deck lids, quarter panels, oil pans, fuel tanks, floor panels, inner and outer door panels and the like. Appliance parts, formed by stamping and drawing as these terms are generally used, include washer tops, dryer tops, washer fronts, dryer fronts, top and front lids and dryer tumblers and the like. Prior to the use of lubricants known as prelubes, the normal procedure was to apply an oil at the steel mill to such coils or rolls as a rust preventative prior to shipping to the processing site, such as a stamping plant. Between the steps of cutting the sheets into blanks and stamping or drawing, these rust preventive oils would be removed by cleaning and a drawing lubricant applied to the metal work element immediately before stamping or drawing. These forming lubricants are used to reduce friction and facilitate the metalworking operation.

In recent times the use of separate rust preventive oils and drawing lubricants has been in some instances replaced by the use of a single composition known as a prelube. Prelubes are generally applied at the steel mill during temper rolling or inspection, as would be a rust preventive oil, prior to shipping and are not removed from the metal until after the blanks are cut and the parts formed. Thus the use of such prelubes eliminates the steps of removing the oil and applying a forming lubricant before further working.

Prelubes, therefore, must function as both a rust preventative and forming lubricant. In many instances, and particularly for automotive and appliance applications, a prelube must be removable with alkaline cleaners, be non-staining to the metal, and be compatible with other chemicals utilized in processing the products in question. Thus the use of prelubes eliminates the tedious process of applying and removing the combination of rust preventative oils and forming lubricants before further working with only one composition. Prelubes thus offer a variety of performance benefits in replacing a multitude of products with one composition.

The advantages obtained by using a prelube would be diminished if unusual methods were necessary to remove the lubricant from the final product. In the automotive and appliance fields, alkaline cleaners are the normal compositions employed for cleaning. These aqueous alkaline cleaners are normally mixtures of amines, inorganic alkalais and biodegradable nonionic surfactants. These cleaners are used today, especially in the automotive industry, at operating concentrations of one-two ounces per gallon and at temperatures from 105° to 125° F. Formed parts are cleaned in a variety of system types utilizing spray, immersion and combination of both. Exposure times range from one to three minutes depending on type of part, metal substrate, lubricant and operating conditions of the alkaline cleaner.

There are times where coated steel coils are stored for long periods before use. Some of the coatings ingredients may oxidize during storage. These oxidation products stain steel sheets, particularly mild steel sheets. Hence, industries in which storage periods are long require prelubes that are substantially non-staining and capable of neutralizing any oxidation by-products.

Parts are sometimes formed with severe bends which may entrap some of the lubricant used in the metalworking operation. Although the lubricant may be removed after working from all exposed surfaces, the entrapped portion remains and may be vaporized or otherwise released under subsequent processing conditions. The potential for the release of entrapped lubricant thus requires compatibility between the lubricant and cathodic primers, automotive adhesives and appliance porcelain coatings. Although some parts being formed in a typical stamping plant will not be painted nor come into contact with adhesives, and thus the use of non-compatible lubricants thereon would pose minimal risks, efficiency in the overall operations makes in highly desirable to utilize the same lubricant or prelube throughout the plant.

The prelubes now used commercially in the automotive and appliance industries are liquid hydrocarbon based compositions containing a variety of chemical components. These compositions tend to drain off the metal surfaces, creating maintenance problems. They tend to be or become unevenly distributed on the metal surfaces due to capillary forces or gravity. The properties of corrosion prevention and drawing assistance both depend in significant part on uniformity of lubricant film. The automotive and appliance industries desire a prelube that provides lubricant film uniformity and film strength undiminished during shipping and storage periods. Further, film strength is a particularly significant property for facilitation forming operations; a lubricant having high film strength will permit more severe draws to be made. When hydrocarbon based compositions are used, housekeeping and cleanliness are extremely hard to maintain. They leak onto tooling surfaces, contaminate floor trenches and waste treatment streams, volatilize into the air and may create dermatitis on the press forming personnel. Automotive and appliance industries require forming lubricants that eliminate these problems either through their chemistry of by being compatible with the existing processes.

A lubricant that is effective for the purposes for which it is intended should be low cost and work at low coating weights, e.g., as a thin film. Traditional hydrocarbon base prelubes are used at coating weights ranging from 300 to 1000 mg/ft$^2$.

To be successful in treating metal for use by automobile manufacturers, it is important the prelube have the property of being easily cleaned and removed by aqueous alkaline cleaners at temperatures as low as 105° F. Also, the prelube must provide good corrosion protection to the part being coated. Furthermore, the prelube must be compatible with the various types of metal substrates used in automotive industry today including cold rolled steel, hot dip galvanized, electro-galvanized and aluminum.

It is an object of the present invention to provide a metalworking lubricant, particularly a solid film prelube, that provides the foregoing desirable characteristics and permits the attainment of the foregoing advantages in the metalworking field, and in particular in the automotive and appliance industries.

It is a further object of the present invention to provide a method of lubricating metal, particularly cold rolled and galvanized steel sheets, prior to stamping and drawing operations, that provides the foregoing desired advantages.

These and other objects of the invention are described below.

GENERAL STATEMENT OF THE INVENTION

The invention comprises a hot melt prelubricant especially adapted for lubricating and protecting sheet metal used in the manufacture of automobiles and appliances and having the property of being easily removed by alkaline cleaners used in such industries which comprise:

| Ingredients | % by weight |
|---|---|
| A. $C_{14}$–$C_{22}$ saturated fatty acid ester of a polyhydric alcohol lubricant | 60.0–65.0 |
| B. Aspartic acid diester of a 1-(2-hydroxy ethyl)2-$C_{11}$–$C_{21}$ imidazoline lubricant | 8.0–15.0 |
| C. Ethylene-acrylic acid copolymer | 0.5-2.0 |
| D. Amide formed from 2 moles of stearic acid with 1 mole of diethanol amine | 20.0–25.0 |

-continued

| Ingredients | % by weight |
|---|---|
| E. Anti-oxidant | 0.5–2.0 |

THE SATURATED FATTY ESTER LUBRICANT

The preferred lubricant includes at least one substantially saturated ester formed of a polyhydric alcohol and at least on $C_{14}$–$C_{22}$ carboxylic acid.

In preferred embodiments the substantially refined saturated ester is formed of an aliphatic polyhydric alcohol having from 2 to 10 carbon atoms. The aliphatic monocarboxylic acids preferably have substantially unbranched carbon chains. The ester preferably has a melting point of from 30° to 100° C.

In more preferred embodiments the substantially saturated ester is a diglyceride or triglyceride formed with carboxylic acids at least 90 percent of which have carbon chains containing from 14 to 22 carbon atoms. A very preferred embodiment is a triglyceride either stearic acid triglyceride, or the substantially refined hydrogenated triglyceride derived from tallow having an acid number 0 to 5, and a saponification number of 190–210.

The fatty acid ester, preferably the substantially refined hydrogenated tallow triglyceride offers improved lubrication versus that of hydrocarbon oil-based systems described earlier. This lubrication is achieved primarily through the solid nature itself of the hot melt lubricant film applied on the metal substrate. In addition, the triglyceride functions as a chemical lubricant film. The hot melt nature of the applied film is due primarily to the solid nature of the refined tallow triglyceride and its 130° F. melt point. As long as temperatures are below the melt point of the solid film prelube composition, there will always be a solid coating present on the metal substrate. This coating separates the metal part from the tooling involved to form the part. Thus, the nature of the solid coating itself allows for significant improvements in lubrication over hydrocarbon oil-based systems.

THE IMIDAZOLINE LUBRICANT-SURFACTANT

The preferred imidazoline lubricant is the aspartic acid diester 1-(2-hydroxyethyl)-2-heptadecenyl imidazoline. This imidazoline is primarily a mixture of diester of L-aspartic acid and an imidazoline based on the reaction between oleic acid and aminoethylethanolamine. This imidazoline composition has an acid value of 50–100 and an alkali value of 5–50 and is a fluid at ambient temperature. Preferably it has an acid value of 65–75 and an alkali value of 30–40. The imidazaline functions as both a lubricant and a surfactant which improves cleanability of the solid film coating when exposed to aqueous alkaline cleaners at 105°–125° F. Furthermore, the imidazaline surfactant described also functions as the primary means of corrosion inhibitor in the applied coating.

THE ETHYLENE COPOLYMER

The ethylene polymer is derived from ethylene and ethylenically unsaturated carboxylic acid monomers, oxidized derivatives thereof, or mixtures thereof. These polymers have a melting point ranging from 85° to 115° C. They have a hardness of from 9 to 22 dmm at 25° C. and an acid number of from 70 to 140. Particularly preferred is a copolymer of ethylene and acrylic acid having a hardness of from 12 to 16 and an acid number of from 110 to 130. Such ethylene polymer significantly improves adhesion of the described invention on the variety of metal substrates described earlier.

THE STEARIC ACID AMIDE OF DIETHANOL AMINE

A material of this type is product Addco S.A. It is described as the stearic acid amide formed from reaction of 2 moles of stearic acid to 1 mole of diethanolamine. The specific gravity is 0.9465. It has a titer point of 130° F., an acid number of 3 to 5. The pH at 1% in water is 9.2. The alkali value (as KOH) is max 4.5%. Its color is light amber. This stearic acid alkanolamide is critical for the removability of the described compositions with aqueous alkaline cleaners at temperatures of 105°-125° F. It allows the described compositions to be emulsified by the nonionic surfactants in the cleaners described earlier and rinsed from the metal substrate. Yet in the presence of only water (humidity or moisture), the stearic acid functions as an effective corrosion inhibitor on the variety of metal substrates described earlier preventing the water from initiating corrosion or staining on the metal substrate. This is particularly important since the described compositions must be removable with standard aqueous alkaline cleaners and yet offer corrosion protection required by automotive manufacturers under test conditions of 100° F. and 100% relative humidity. This type of amide is critical for product performance. Other types of stearic acid alkanolamides are well known in the industry. The vast majority of these amides are 2:1 amides, formed from the reaction of 2 moles of monoethanolamine or diethanolamine with 1 mole of stearic acid. These 2:1 amides offer only moderate cleanability with poor corrosion protection. The 2:1 amide, Addco SA, used in the described invention offers both excellent cleanability in conjuction with excellent corrosion protection because of its unique reaction of 2 moles of stearic acid to 1 mole of diethanolamine.

THE ANTIOXIDANTS

The lubricant may also contain from 0.1 to 2.0 weight percent of a preferred hindered phenol antioxidant, preferably 2,6-di-tertiary-butyl-para-cresol with a melting point of 147° F. An antioxidant when higher melting point formulas are desired is Vanlube 81, p,p'-diocatyldiphenylamine.

COATING THICKNESS AND METHOD OF APPLICATION

The lubricants of the invention are usually applied at a rate of 50-500 mg/ft$^2$. The thickness is typically between 0.027 to 0.27 mils. Preferably it is between 50 to 150 mg/ft$^2$, typically 0.027 to 0.081 mils.

The temperatures at which the lubricants are applied are between 10°-35° above their melting point. The temperature of the metal surface to which the lubricant is applied can range from ambient temperature to 50° F. above the melt point of the described compositions. The preferred method of application for the described invention is by rollcoating where the described invention in a molten form is applied to a moving metal strip (speed from 400 to 4000 feet per minute) via a rollcoater at the conditions described above. In addition, the compositions can also be applied via electrostatic spray methods.

COMPOSITION A

| Ingredients | Weight Percent |
|---|---|
| 1. Refined hydrogenated tallow triglyceride | 63.7 |
| 2. 2,6-di-tertiary-butyl-para-cresol | 1.0 |
| 3. Ethylene-acrylic acid copolymer | 1.0 |
| 4. Aspartic acid diester 1-(2-hydroxyethyl)-2-heptadecenyl imidazoline | 11.4 |
| 5. 2 mole stearic acid - 1 mole diethanol amine alkanolamide reaction product | 22.9 |

The advantages and utility of the lubricant, according to the present invention, are further described in the following listed examples.

EXAMPLE 1

A hot melt, solid film prelubricant especially adopted for the lubricating and protecting of sheet metal used specifically in the manufacture of automobiles and appliances and having the property of being easily removed by the alkaline cleaners used in such industries, according to the present invention, was prepared as follows:

One blending vessel equipped with mechanical means of heating and stirring was used. The vessel was well insulated to allow for both uniform heating and cooling.

The following ingredients were added and mixed in the vessel: 63.7 parts by weight of a refined hydrogenated tallow triglyceride, commercially available under the registered trademark of NEWSTRENE 060 from Humko Chemical Division of Witco Chemical Company; 1.0 parts by weight of a hindered phenol antioxidant, available commercially under the Rhone-Poulenc tradename of UNIVOX 1494; 1.0 parts by weight of an ethylene-acrylic acid copolymer, commercially available under the Allied Corporation trademark AC-143; 11.4 parts by weight of an oleylimidazoline-aspartic acid diester blend, commercially available under the Mona Industries, Inc. trademark, MONACOR 39; and 22.9 parts by weight of a 2:1 stearic acid-diethanolamine alkanolamide commercially available from Gateway Additive under the tradename of ADDCO SA AMIDE.

The blend of components was heated with moderate agitation to 180° F. and stirred until all components have melted and the blend was uniform and homogenous in color and appearance. Heat was then shut off and mixture cooled by gentle mixing to 150° F. before final packaging. The final product is a hard, tannish solid with mild aroma and homogenous form and consistency.

The product can be characterized as follows:

| | |
|---|---|
| Appearance: | Tan solid |
| Odor: | Fatty acid aroma |
| Melt Point (°F.): | 135-140 |
| Acid Value: | 4.0-10.0 |
| Specific Gravity: | 0.89-0.90 |
| Penetrometer Hardness (25° C.): | 0.5-1.5 mm |
| Conductivity (mega ohms at 150° F.): | 0.1-1.0 |

EXAMPLE 2

The lubricant prepared in Example 1 was coated onto various types of steel panels in laboratory as follows by two different methods. Test panels are purchased from major panel manufacturers and are usually 3"×6" or 4"×6" in size. Test panels are obtained from ACT and represent four substrates:

a. General Motors unpolished cold rolled steel
b. General Motors 16-18E hot dip galvanized
c. General Motors 16-90E electrogalvanized
d. Chrysler G60/AO1 galvaneal Before coating, all test panels are cleaned with Xylene and hexane. When dry, the panel weight was recorded to 1/10,000th of a gram on a precise analytical balance (such as a Mettler). The lubricant was applied to steel test panel at ambient conditions by one of two methods:

1. Method 1: Placing the test panel on a warm hot plate (surface temperature approximately 200° F.) and brushing lubricant (warmed separately to 170° F. until lubricant is molten) onto the panel. Standard paint brushes with high melting polyalphaolefin bristles are used. Brushes are either two or three inches wide. An initial heavier application is made to ensure adequate coverage followed by a thirty minute cooling period. The panel is then once again placed on the hot plate and a clean brush used to remove excess coating to reduce coating weight to a specific weight. Panels are then cooled again and placed on the hot plate one final time to reflow the coating.

2. Method 2: Lubricant is dissolved at a specific concentration in a solvent such as trichloroethane by warming the mixture to 160° F. Test panels are immersed in the lubricant-solvent solution for five seconds, withdrawn from the solution and placed in a vertical position. A hot air gun is used to blow warm air over both sides of the test panel (panel held in upright position with a plastic hook and gun held 10 to 12 inches from metal surface) to dissipate the solvent and reflow the coating.

While being coated, test panels are always handled by the preparer wearing disposable latex gloves to prevent surface metal contamination. Coated panels are allowed to cool at ambient temperatures for sixty minutes. The coated panels were then reweighed again on the same scale and lubricant coating weights are then calculated and reported in milligrams per square foot.

The coated methods described above are adequate for only small laboratory applications and preparations. For commercial applications, the lubricant may be applied by one of three methods:

A. Warming the lubricant above its melt point and applied to a moving steel strip by an electrostatic spray. The steel strip will pass through an insulated chamber containing warm air approximately at 100° F. and dual sets of application spray blades.

B. Diluting the lubricant in a solvent such as Xylene or SC-150 at a concentration of 5.0 to 15.0 weight percent. The moving steel strip is passed through a bath of the lubricant or a series of coating rolls apply the lubricant from the pan onto the strip. A series of ovens are used to dissipate the solvent, reflow the coating and cool the lubricant coating to ambient temperature.

C. Applying the lubricant in a molten form (temperature above the melt point) to a moving steel strip by a series of coating rolls. A series of ovens are used to reflow the coating and a waterfall quench is used to cool the lubricant coating to ambient temperature.

Despite the variety of coating methods, the lubricant, according to the present invention; provides a transparent, smooth film (which is hard yet pliable) on all types of steel with excellent surface adhesion and wetting properties providing a homogeneous and consistent film coating on the metal from a minimum coating weight of 50 mg/ft$^2$ to a maximum of 1000 mg/ft$^2$.

EXAMPLE 3

The solid film prelube composition prepared in Example 1 was tested to determine its forming and drawing characteristics on four steel substrates using the double draw bead simulator. 2"×12" test strips were coated as described in Method 1 of Example 2. Four test substrates used were the four listed in Example 2: cold rolled steel, hot dip galvanized, electrogalvanized and galvaneal. All four steel substrates are currently in use at both General Motors and Ford Motor Company.

Solid film composition was applied to an area of 2"×5" on both sides at one end of each strip. Test strips were aged 24 hours at ambient temperature prior to testing. Three test strips were produced for each lubricant of each steel substrate type. Average coating weights were 100+/−10 mg/ft$^2$. Test strips were then drawn through a pair of mated dies containing a series of three fixed draw bead surfaces in an A shape configuration. Strips were placed in fixed grips at one end with a grip pressurization of 3,000 psi. Strips were pulled a total distance of five inches through the dies at the rate of 100 inches per minute, a total downward force of 11,000 pounds exerted on the strips. An individual coefficient of friction is calculated for each coated strip followed by an average coefficient of friction for each set of three test strips for each lubricant and substrate combination. Coefficients of friction are calculated using the following equation:

$$\mu = \frac{B - A}{\text{pi} \times C}$$

$\mu$ is coefficient of friction
A is roller draw load
B is fixed draw load
C is fixed draw normal load.
A and B would represent the pulling forces, while C is the normal force. Pi is in the denominator to compensate for bead geometry.

Three commercial prelubes were also evaluated for comparative purposes, two hydrocarbon oil-based and one acrylic-stearate polymer. In comparison, average coefficients of friction are listed below:

| | AVERAGE COEFFICIENT OF FRICTION | | | |
|---|---|---|---|---|
| Prelube | Cold Rolled Steel | Hot Dip Galvanized | Electro-galvanized | Galvaneal |
| Composition A | 0.0813 | 0.0876 | 0.0461 | 0.0816 |
| Oil Lubricant 1 | 0.1202 | 0.1140 | 0.0873 | 0.0961 |
| Oil Lubricant 2 | 0.1734 | 0.1613 | 0.1436 | 0.1780 |
| Acrylic-Stearate | 0.1476 | 0.1348 | 0.1293 | 0.1369 |

The solid film prelube composition described in Example 1 provided better lubrication (based on lower average coefficients of friction) versus the three commercial prelubes on all four steel substrates evaluated.

EXAMPLE 4

The solid film prelube emulsion composition prepared in Example 1 above was evaluated to determine whether it would provide the necessary corrosion protection required for steel substrates during long periods of storage and transit in varying conditions of humidity and temperature. The Cleveland condensing humidity cabinet is one of an accelerated nature whereby exposure to the combined adverse conditions of temperature and humidity are increased thereby reducing the time factor for practical reasons.

Coatings were evaluated on 4"×6" test panels of the four steel substrates listed in Example 3: cold rolled steel, hot dip galvanized, electrogalvanized and galvaneal. Panels were coated via Method 1 as described in Example 2. Coatings were applied to achieve a dry coating weight of 150+/−10 mg/ft$^2$ to one side of each test panel. Panels were then aged 24 hours at ambient temperature prior to testing.

The test chamber consisted of an atmosphere of condensing humidity at 100° F. and 100% humidity. Water vapor circulated continually in the chamber, condensing on the coated surfaces of test panels facing the internal chamber of the test cabinet. Water vapor condensed on the coated surfaces of the panels continually washing the panel surfaces. Panels were always handled while wearing disposable latex gloves to prevent surface contamination on the coatings from salts and oils commonly found on human skin. Panels were examined every 24 hours and testing concluded after 35 days exposure. Test panels were placed at fifteen degree angle of incline (from the vertical) on the chamber.

For comparison, as in Example 3, three commercial prelubes (two hydrocarbon oil-based and one acrylic-stearate polymer) were also run. Since all three commercial prelubes fell seriously short on corrosion performance versus Composition A, they are presented separately since their exposure times were much shorter. Results are summarized below:

| | CORROSION BY SUBSTRATE | | | |
|---|---|---|---|---|
| Composition A | Cold Rolled Steel | Hot Dip Galvanized | Electro-galvanized | Gal-vaneal |
| (35 day exposure) | 2% pinpoint rust | 5% edge stain | None | None |
| Commercial Prelubes | | | | |
| Oil Lubricant 1 (5 days exposure) | 10% rust | 100% stain | 5% stain | 5% stain |
| Oil Lubricant 2 (2 days exposure) | 100% rust | 100% stain | 100% stain | 50% stain |
| Acrylic-Stearate (6 days exposure) | 5% rust | 100% stain | 10% stain | None |

The solid film prelube composition described in Example 1 provided excellent corrosion protection as tested (under the conditions of temperature and humidity tested) on all four steel substrates versus the three commercial prelubes.

In addition, Phase I corrosion testing for automotive applications were run and confirmed by independent laboratory testing. These tests are corrosion specifications determined by both Ford Motor Company and General Motors for automotive approval. Tests and results for three steel substrates are summarized below:

A. Ford Specification M-14B90A-B(F) consists of a consecutive 72 hours exposure cycle on Cleveland condensing humidity cabinet at 100° F. and 100% relative humidity. Solid film prelube described in Example 1 was tested at coating weight of 300 mg/ft$^2$ versus the control mill oil specified at 800 to 900 mg/ft$^2$. Results were:

| | DEGREE OF CORROSION | | |
|---|---|---|---|
| Prelube | Cold Rolled Steel | Hot Dip Galvanized | Electro-galvanized |
| Composition A | 1% pinpoint rust | None | None |
| Control Mill Oil | 5% rust | 25% stain | None |

The solid film prelube described in Example 1 provided equivalent or better corrosion protection than the control mill oil on all three steel substrates and would thus meet Ford Motor Company requirements.

B. General Motors Specification 52-29 consists of a ten cycle corrosion test, each cycle consisting of eight hours exposure at ambient temperature and sixteen hours exposure in the humidity cabinet at 95° F. and 100% relative humidity. Solid film prelube described in Example 1 was tested at coating weight of 300 mg/ft$^2$ versus control oil specified at 800 to 900 mg/ft$^2$. Humidity cabinet is maintained according to ASTM D-2247-87 test procedure. Ten cycles run were consecutive. Results were:

| | DEGREE OF CORROSION | | |
|---|---|---|---|
| Prelube | Cold Rolled Steel | Hot Dip Galvanized | Electro-galvanized |
| Composition A | 5% rust | None | 5% stain |
| Control Mill Oil | 35% rust | 90% stain | 75% stain |

The solid film prelube described in Example 1 provided better corrosion protection than the control mill oil on all three substrates and would thus meet General Motors requirements.

EXAMPLE 5

Cleanability, defined as the total removal of a solid film prelube coating, is extremely important. After metal parts are formed, the parts may be transferred to a variety of future processing operations including welding, bonding via use of structural adhesives or the deposition of a wide range of coatings including phosphate coatings and electrically applied primers and top coats.

For this reason, the solid film prelube composition described in Example 1 was tested for its removability via standard aqueous alkaline cleaners (at their recommended operating parameters) that are used in the U.S. automotive industry. Cleanability tests were run in a power spray wash unit, a self-enclosed system where alkaline cleaner solution is recirculated in a closed loop system. Cleaner solution is continuously heated in line and is applied to test panels hanging within the test chamber over a range of application pressures from five to thirty-five psi. Solid film prelube composition described in Example 1 was applied to test panels (4"×6") of four substrates described in Example 3 via laboratory coating Method 1 described in Example 2. The four test substrates were cold rolled steel, hot dip galvanized, electrogalvanized and galvaneal. Coating was applied to one side of the test panels to achieve a dry coating weight of 150+/−10 mg/ft$^2$.

Two cleaning schemes were used, using powdered alkaline cleaners produced by Parker-Amchem. Two regiments are described below:

1. Parco 1500C run at a concentration of two ounces per gallon at temperature of 105°+/−1° F. Panels were exposed for two minutes to a spray solution applied at 20 psi.

2. Parco 2331 run at a concentration of one ounce per gallon at temperatures of 120°, 130° and 140° F. Panels were exposed for one minute to a spray solution applied at 20 psi. Temperature variance for all three application temperatures was plus or minus one degree.

Following both cleaning schemes, panels were rinsed for thirty seconds in a deionized water rinse spray applied at 20 psi. Panels were then fully immersed in a saturated aqueous copper sulfate solution (slightly acidic) which deposits a uniform copper coating on all cleaned areas. This presents an excellent visual record of the degree of cleanability. Results are presented below:

| | DEGREE OF CLEANABILITY | | | |
|---|---|---|---|---|
| | Cold Rolled Steel | Hot Dip Galvanized | Electro-galvanized | Gal-vaneal |
| 1. Parco 1500C at 105° F. | 95-100% clean | 100% clean | 100% clean | 100% clean |
| 2. Parco 2331 | | | | |
| at 120° F. | 100% clean | 100% clean | 100% clean | 100% clean |
| at 130° F. | 100% clean | 100% clean | 100% clean | 100% clean |
| at 140° F. | 100% clean | 100% clean | 100% clean | 100% clean |

The solid film prelube composition described in Example 1 was easily removed on all test substrates with both of the automotive alkaline cleaners at their recommended operating conditions.

To develop further data on the type and size of automotive filtering required to remove the solid film prelube composition described in Example 1 from automotive cleaner streams, work was conducted to develop initial observations on the filtering behavior of Composition A in an alkaline stream of Parco 1500 C cleaner at concentration of two ounces per gallon in deionized water.

3,000 ml. of cleaner solution was contaminated with 1% Composition A (30 grams finely ground) and warmed with agitation to 110° F. Bath was cooled by gentle agitation to 100° F. and then allowed to cool overnight to ambient temperature. Polypropylene bag filters were obtained from production ranging in size from one micron to 800 microns (1, 5, 10, 25, 50, 100 and 800).

After cooling overnight, Composition A was settled out on the top of the cleaner in a semi-solid emulsified state. The cleaner stream containing the emulsified Composition A was poured through a 100 micron production filter and the stream was observed for any signs of Composition A that may have penetrated the filter.

There was no blinding of the filter. The filter easily removed the Composition A solids with the alkaline cleaner solution easily passing through. Filters in size range of 75 to 100 microns would effectively remove the solid film prelube described in Example 1 from cooled alkaline cleaner solutions of Parco 1500 C maintained at 105°−100° F.

Furthermore, cleanability testing has also been done in actual cleaning lines in automotive forming and assembly plants across the country. 4"×12" panels (substrates described in Example 3) were run through the cleaner line at major automotive plant in northern Great Lakes area. The panels were successfully cleaned in their eleven stage cleaner line which utilized Parco 2331 alkaline cleaner at 120° F. as the primary alkaline cleaner, followed by phosphate operation. The phosphate coatings, in comparison to the control panels (clean and bare panels of all substrates), were uniform and homogenous in appearance and morphology. There was no difference between phosphate coatings on control versus treated panels (coated with Composition A at 75 mg/ft$^2$ via Method 1 in Example 2.

Four by three inch samples were removed from each of the six panel substrates and phosphate coating weights determined by weigh-strip-weigh. A concentrated ammonium hydroxide/ammonium dichromate aqueous solution at 120° F. was used to strip the phosphate coating from both sides of the panel samples. Panels were exposed for ten minutes followed by one minute rinse in tap water. Phosphate coating weights (average value for both sides) are listed below in milligrams per square foot.

| | DEGREE OF CORROSION | | |
|---|---|---|---|
| | Cold Rolled Steel | Hot Dip Galvanized | Electro-galvanized |
| Composition A | 269.5 | 307.9 | 268.3 |
| Control | 230.4 | 306.1 | 225.0 |

Phosphate coating weights were very uniform.

EXAMPLE 6

Besides being compatible and removable with automotive processing cleaning systems, prelubes must also be compatible with structural body adhesives used to bond automotive structural body components together. Solid film prelube composition described in Example 1 was evaluated in compatibility tests with structural body adhesives versus General Motors Test Procedure 3623M. Control combination of a commercial mill oil covered with a commercial drawing compound are tested for comparative purposes. Strip of 1"×4" two side electrogalvanized steel were cleaned with toluene and air dried. Solid film prelube described in Example 1 was applied by hot melt method described in Method 1 in Example 2, to both sides of one end (one by one inch area) of several test strips at coating weight of 100 mg/ft$^2$. For control strips, strips are prepared by dipping the strips in the mill oil, draining overnight and then applying drawing compound over the mill oil. PPG-Hughes HC5099 structural body adhesive was used to prepare test setups (two strips joined end to end, oriented in same direction and overlapped one inch). Strips are clamped and baked in forced air oven for 60 minutes prior to testing. Strip sets were then pulled apart in an Instron Shear Tester to determine the adhesive failure point of the bonded strips (force required to pull the strips apart breaking the adhesive bond). The strips were pulled apart at a uniform rate of one-half inch per minute, starting at a minimum distance of four inches between the jaws. The failure point of the body adhesive must be a uniform failure, breaking point occurring at ends of the strips between the adhesive. Results are summarized below for each test:

| TEST | AVERAGE BOND STRESS FAILURE POINT (psi) Composition A | Control |
|---|---|---|
| 1. Shear Stress Test: 168 hours at ambient temperature | 2598(pass) | 2521(pass) |
| 2. Shear Stress Test: 168 hours immersion in water at 130° F. | 2176(pass) | 2040(pass) |
| 3. 20 Cycle Scab Corrosion Shear stress test | 1872(pass) | 1888(pass) |
| 4. Six Week Stress Shear | 2434(pass) | 2280(pass) |
| 5. 30 Cycle Scab Corrosion Shear stress test | 2102(pass) | 2051(pass) |

The solid film prelube composition described in Example 1 offered equivalent bonding strength to the control combination and passed all five phases of test sequence, having no negative effects on the bonding strength of the automotive adhesive.

EXAMPLE 7

Once metallic parts are formed, trace amounts of a prelube coating can enter the plant waste treatment process either concentrated (removed via filtering, skimming or centrifuging from the alkaline cleaner stream) or diluted in the entire alkaline cleaner stream when portions of or the entire stream is dumped. The prelube contaminant cannot interfere in any way with the overall treatment process nor any of the individual treatment chemicals used in the process. The solid film prelube composition described in Example 1 was evaluated in a standard A-IV laboratory emulsion test for waste treatability. Emulsions were innoculated with dosages of composition described in Example 1 (0.5% or 5000 ppm and 1.0% or 10,000 ppm). Mixtures were then treated with 350 ppm of Nalco N-7722 cationic polymer and 0.35 ml of alum solution. Final treatment process consisted of treatment with Nalco N-7763 anionic polymer and skimming of the solids. COD values were then run on the clear, bottom water layers that remained. COD values are listed for:

a. alkaline cleaner streams by themselves (Parco 1500C at two ounces per gallon and Parco 2331 at one ounce per gallon)

b. alkaline streams contaminated with a commercial mill oil at levels of one and three percent by weight c. alkaline streams contaminated with solid film prelube composition described in Example 1 at levels of one and three percent by weight. COD values of the effluent water layers are used as the comparative values.

| SAMPLE | EFFLUENT COD VALUE (ppm) |
|---|---|
| A. Control Emulsion | 1100 |
| B. Parco 1500C cleaner | |
| 5,000 ppm | 1100 |
| 10,000 ppm | 1200 |
| C. Parco 2331 cleaner | |
| 5,000 ppm | 1100 |
| 10,000 ppm | 1100 |
| D. Parco 1500C cleaner (1% mill oil) | |
| 5,000 ppm | 1100 |
| 10,000 ppm | 1200 |
| E. Parco 1500C cleaner (3% mill oil) | |
| 5,000 ppm | 1000 |
| 10,000 ppm | 1100 |
| F. Parco 2331 cleaner (1% mill oil) | |
| 5,000 ppm | 1100 |
| 10,000 ppm | 1100 |
| G. Parco 2331 cleaner (3% mill oil) | |
| 5,000 ppm | 1100 |
| 10,000 ppm | 1100 |
| H. Parco 2331 cleaner (1% Composition A) | |
| 5,000 ppm | 1100 |
| 10,000 ppm | 1100 |
| I. Parco 2331 cleaner (3% Composition A) | |
| 5,000 ppm | 1100 |
| 10,000 ppm | 1000 |
| Tested at 10,000 ppm only | |
| J. Parco 1500C cleaner (1% Composition A) | 1100 |
| K. Parco 1500C cleaner (3% Composition A) | 1100 |

As can be seen, the results clearly indicate that the solid film prelube composition described in Example 1 was easily waste treatable and had no negative effects on the treatment product dosage levels or effluent COD values. There was no negative impact on the treatability of the alkaline cleaner streams containing it. Furthermore, the COD values for Composition A were equivalent to those of the commercial mill oil contaminant that would normally be encountered in alkaline cleaner stream. The lubricant composition described in Example 1 will have no effects on standard waste treatment processes and will be easy to waste treat itself.

EXAMPLE 8

Trace amounts of prelubricants cannot interfere with the welding of structural body components, especially in the automotive industry where spot welds are used to attach body panels to each other such as an outer door panel to an inner door panel. The prelubricant film cannot affect the weld current itself nor the quality or size of the weld itself. In addition, no noxious or hazardous fumes can result from the decomposition of the coating upon vaporization from welding heat. The lubricant described in Example 1 was applied via the hot melt method described in Method 1 in Example 2 to cold rolled steel test panels at coating weight of 100 mg/ft$^2$. Spot weld tests were run according to automotive specifications Ford 13-4 and General Motors MDS-247. Bare panels were used as a control. Tests are based on the weld current necessary to achieve a minimum weld nugget size. Results for both test are summarized below:

| A. Ford Range Test 13-4 | Minimum Current | Maximum Current | Current Range |
|---|---|---|---|
| Bare Control | 8810 amps | 10620 amps | 1810 amps |
| Composition A | 8770 amps | 10560 amps | 1790 amps |
| Required | N/A | N/A | 1500 amps |

Range and intensities for both bare control and described invention were very similar and easily satisfied Ford range requirement of 1500 amps minimum.

| B. G. M. Range Test MDS-247 | | | |
|---|---|---|---|
| | Minimum Current | Maximum Current | Current Range |
| Bare Control | 7780 amps | 10450 amps | 2670 amps |
| Composition A | 8870 amps | 10980 amps | 2110 amps |
| Required | N/A | N/A | 1800 amps |

The described invention surpassed the minimum GM range requirement of 1800 amps. Thus the described invention in Example 1 would be compatible with and have no negative effects upon the current welding processes being used in automotive industry.

Chemical analysis of gaseous by-products from decomposition of the solid film prelubricant described in Example 1 were determined to be water and carbon dioxide. Both are the simple end products of normal long chain hydrocarbon decomposition. Both of these by-products are non-hazardous and would pose no health threat.

EXAMPLE 9

Scanning electron microscope photos (S.E.M.) of solid film prelubricant coatings are utilized in evaluating and interpreting both the structural and functional characteristics of solid film prelubricants. These characteristics can include the morphology of the coating itself, uniformity of the film and the degree of coating coverage on the metal substrate. Photos were taken of the solid film prelubricant described in Example 1 at 100 mg/ft$^2$ on General Motors electrogalvanized steel. Photos were also taken of the bare metal substrate. The photos were taken at magnification of 100 X in normal mode. The morphology of the solid film prelubricant on a metal substrate (presence or absence of film layers, presence of pores, craters or cracks and surface contours) plays an important role in all performance parameters of the solid film prelube coating. Those parameters can include lubrication, corrosion protection and cleanability.

Photos reveal the bare substrate to be extremely uniform and homogenous. The zinc coating is essentially flat, lacking any definitive surface features such as peaks or valleys. The coating is mildly mottled but no pores, cracks or any other type of penetration are present into the coating.

Photos reveal that Composition A described in Example 1 to appear slightly mottled with this pattern caused by a series of flattened spots or platelets (overlapping) across the metal surface. The platelets vary in shape and size but their pattern and frequency are fairly uniform. Platelets are slightly elongated in the same plane creating a series of linear, parallel peaks across the metal substrate. The peaks are of varying lengths and predominant across the surface. These linear peaks create a series of parallel lines in the coating which are highly visible and likely to be shallow depressions between the peaks. The photos reveal that coverage is uniform and homogenous on the electrogalvanized substrate and is complete with the surface devoid of any bare spots. No gaps, pores or cracks were visible in the coating which would function as potential avenues for moisture and oxygen to penetrate to the metal substrate initiating the formation of corrosion. The composition described in Example 1 provides a uniform and homogenous prelubricant coating with desirable performance benefits associated with those morphological features.

I claim:

1. A hot melt prelubricant especially adapted for lubricating and protecting sheet metal used in the manufacture of automobiles and appliances and having the property of being easily removed by alkaline cleaners used in such industries consisting essentially of:

| | Ingredients | % by weight |
|---|---|---|
| A. | $C_{14}$-$C_{22}$ saturated fatty acid ester of a polyhydric alcohol lubricant | 60.0–65.0 |
| B. | Aspartic acid diester of a 1-(2-hydroxy ethyl)2-$C_{11}$-$C_{21}$ imidazoline lubricant | 8.0–15.0 |
| C. | Ethylene acrylic copolymer | 0.5–2.0 |
| D. | Amide formed from 2 moles of stearic acid with 1 mole of diethanol amine | 20.0–25.0 |
| E. | Antioxidant | 0.5–2.0 |

2. The hot melt prelubricant of claim 1 where:

A is a refined hydrogenated tallow triglyceride;

B is 1-(2-hyrdoxyethyl)2-heptadicenyl imidazoline; and,

E the antioxidant is a hindered phenol.

* * * * *